US005118097A

United States Patent [19]

Cousins

[11] Patent Number: 5,118,097

[45] Date of Patent: Jun. 2, 1992

[54] PARALLEL ROTATION BAR

[76] Inventor: Robin J. Cousins, P.O. Box 939, 480 Cottage Grove Rd., Lake Arrowhead, Calif. 92352

[21] Appl. No.: 681,946

[22] Filed: Apr. 8, 1991

[51] Int. Cl.[5] ..... A63B 1/12

[52] U.S. Cl. ..... 482/41; 482/38; 482/93; 472/16

[58] Field of Search ..... 272/93, 109, 62, 63, 272/123, 70, 61, 97, 33 R; 280/841

[56] References Cited

U.S. PATENT DOCUMENTS

| | | | |
|---|---|---|---|
| 3,083,037 | 3/1963 | Gordon | 272/115 |
| 3,141,669 | 7/1964 | Yun Chul | 272/33 R |
| 3,164,382 | 1/1965 | Johnson | 272/33 R |
| 3,276,777 | 10/1966 | Pruitt | 272/33 R |
| 3,826,488 | 7/1974 | Hall | 272/115 |
| 4,274,639 | 6/1981 | Flanders | 272/119 |
| 4,402,500 | 9/1983 | Cole | 272/33 R |
| 4,746,116 | 5/1988 | Inada | 272/33 R |
| 4,822,035 | 4/1984 | Jennings | 272/123 |
| 4,961,574 | 10/1990 | Law | 272/109 |

*Primary Examiner*—Richard J. Apley
*Assistant Examiner*—Jerome Donelly
*Attorney, Agent, or Firm*—Joseph E. Mueth

[57] ABSTRACT

A pair of parallel bars forming part of a rectangular frame, mounted for rotation relative to two end handles and having locking pins to prevent rotation, adapted to be used for gymnastic exercises and to be carried by two ice skaters.

5 Claims, 2 Drawing Sheets

PARALLEL ROTATION BAR

BACKGROUND OF THE INVENTION

U.S. Pat. No. 3,526,399 to G. H. Jette, discloses a rotatable bar which may be supported across a door jamb or below a diving board for arm and shoulder development comprising a rotatable crank member having aligned end portions and intermediate oppositely offset portions carrying handgrips, a pair of detachable slotted end wall engaging support blocks having attached thereto two U-shaped members with oppositely inturned hook ends. The U-shaped members are installed to engage with an overhead support surface. The blocks are spaced apart to receive the aligned end portions of the rotatable crank, each of the U-shaped members supporting a single bearing block.

U.S. Pat. No. 636,033 to Stirk discloses a revolving trapeze in which two hubs rotate about a common axis and carry a plurality of parallel bars rigidly mounted therebetween. The revolving trapeze includes a horizontal stationary rod or axis, supports to which the ends of the rods are rigidly fixed, hubs mounted to rotate on the rod adjacent to its ends, a tubular sleeve rigidly joining the hubs, radiating arms carried by the hubs in opposite pairs, horizontal bars supported at the outer ends of the arms, stay-rods detachably connected to the adjacent arms at opposite sides of the device, and detachably mounted rods connecting the stay rods in pairs to the hubs.

The present invention is adapted to be carried at each of its end handles by persons who hold the device while the performing person engages in acrobatics on the frame. The device of this invention is adapted to provide for the performance of highly artistic and aesthetically pleasing acts on the frame while the frame is being carried along at each of its ends over an ice rink, skating rink or stage. The device of the present invention represents a significant advance in the art.

SUMMARY OF THE INVENTION

Briefly, the present invention comprises a pair of parallel bars forming part of a rectangular frame, mounted for rotation relative to two end handles and having locking pins to prevent rotation, adapted to be used for gymnastic exercises and to be carried by two ice skaters.

It is an object of this invention to provide a novel rotatable frame device.

It is an object of this invention to provide a novel portable device for use in acrobatic acts.

It is a further object of this invention to provide a device which facilitates the performance of acts of great acrobatic and artistic nature.

These and other objects and advantages of the invention will be apparent from the more detailed description which follows, particularly when taken with the accompanying drawings.

DESCRIPTION OF PREFERRED EMBODIMENTS

Turning to the drawings.

Figure 1:
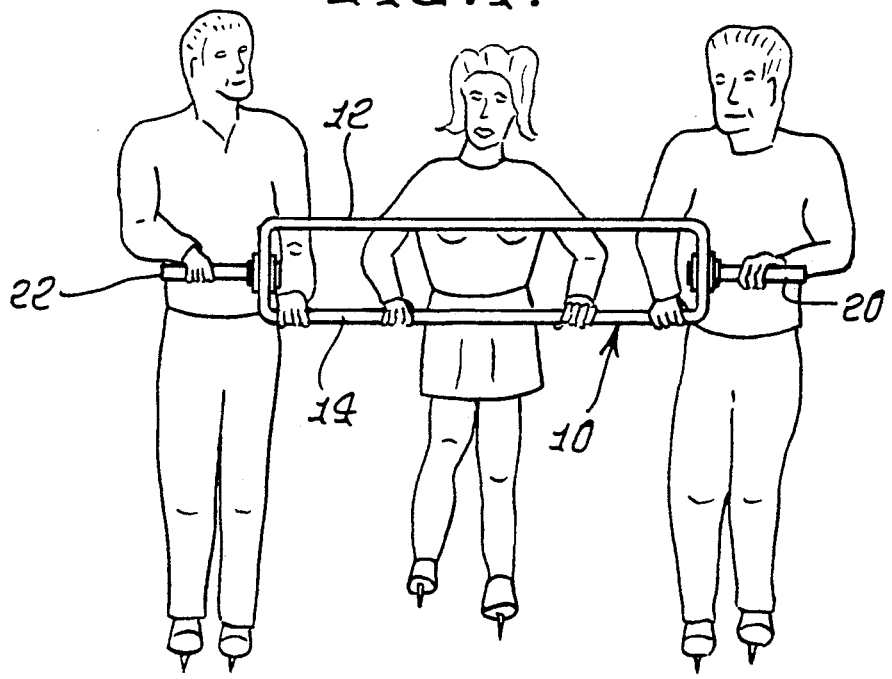
FIG. 1 is a front view showing the portable rotatable frame of this invention carried by ice skaters at each of its end handles, with the performer in the middle, ready to begin an acrobatic act o the frame.

Turning to the drawings in detail, the frame, generally 10, has two spaced apart bars 12 and 14 forming part of the rectangular frame. The bars 12 and 14 are spaced apart about twelve inches. The side members 16 and 18 complete the frame. The frame is normally made of one inch hollow steel tubing. The end handles 20 and 22 are adapted to be held and carried as shown in FIG. 1.

The entire frame 10 is rotatable about the end handles 20 and 22.

The structure of the junction of the handles 20 and 22, and the frame 10 consists at each end of steel plates 24 and 26 welded to the tubing 16 and 18, respectively, and to the cylindrical collars 28 and 30. The collars are welded to plates 24 and 26 and tubing 16 and 18.

Figure 5:
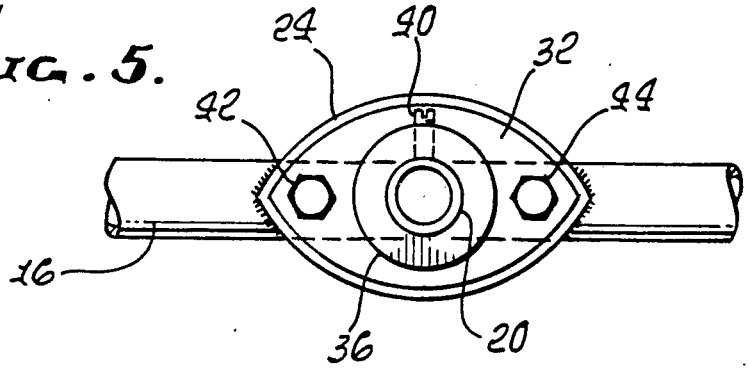
FIG. 5 is a partial enlarged end view of the device of FIGS. 3 and 4.

Self centering bearings 32 and 34, permit the frame 10 to rotate with respect to the end handles. The outside locking collars 36 and 38 hold bearings 32 and 34 in place. The locking collars 36 and 38 are affixed to end handles 20 and 22 by Allen screws which are radially threadably received in each collar. The inner end of each of the Allen screws engages the surface of handles 20 and 22 to hold the handles in place so that they cannot slide back and forth. The Allen screw 40 at the right hand end of the device is shown in dotted lines in FIG. 5. The Allen screws provide for adjustment of the handles to any desired length by loosening the screws, positioning the handles, as desired, tightening the screws. The hex bolts 42 and 44 shown in FIG. 5 (which are also present at the left hand left of the device) hold the self centering bearings 32 to the plate 24, and hence to the collar 28 and the tubing 16. The inside of self centering bearings 32 are lined with roller or ball bearings to provide a surface within which relative rotation with handle 20 can take place.

The cylindrical collars 28 and 30 each have a hole 46. There are complementary holes (not shown) in each of the handles 20 and 22. When the holes are aligned, locking pins can be inserted to prevent relative rotation between the rectangular frame and the handles. For some exercises and maneuvers, it is desirable that there be no rotation. The device can thus be made to be rotatable or not to accommodate the various and different acrobatic acts one wishes to perform on the frame 10.

Figure 2:
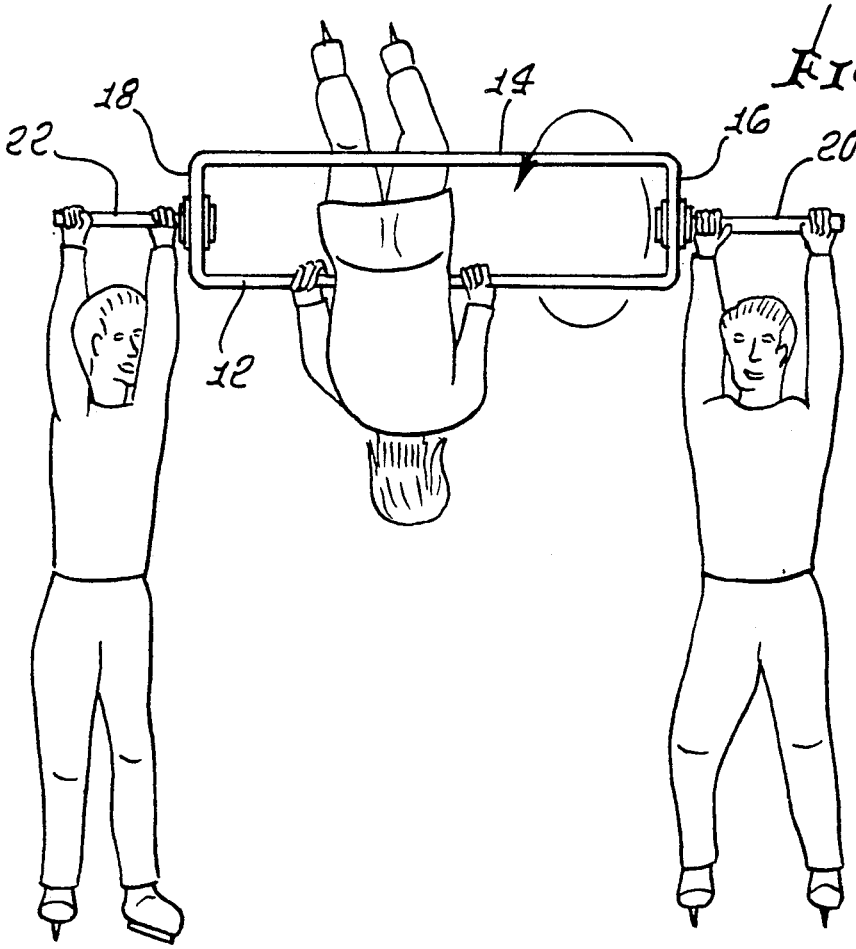
FIG. 2 shows a frontal view with the performer in the course of an acrobatic movement about the frame.
Figure 3:
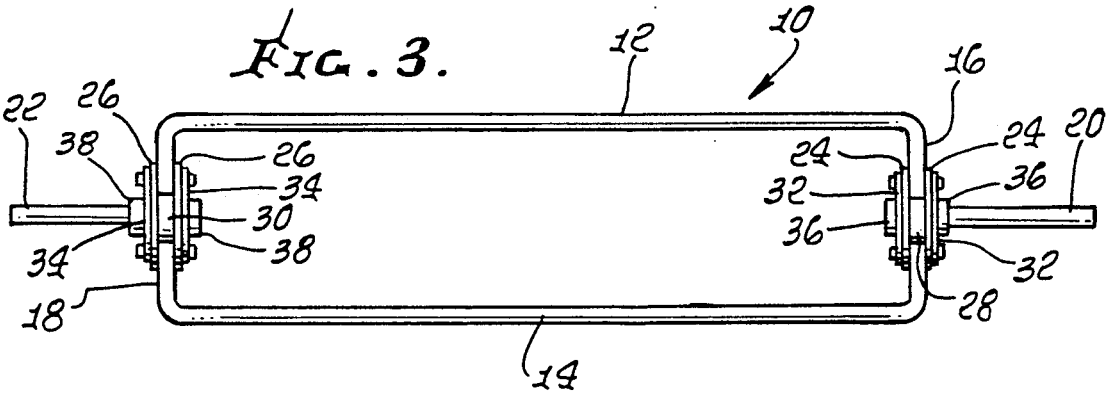
FIG. 3 is a front plan view of the device of the present invention.
Figure 4:
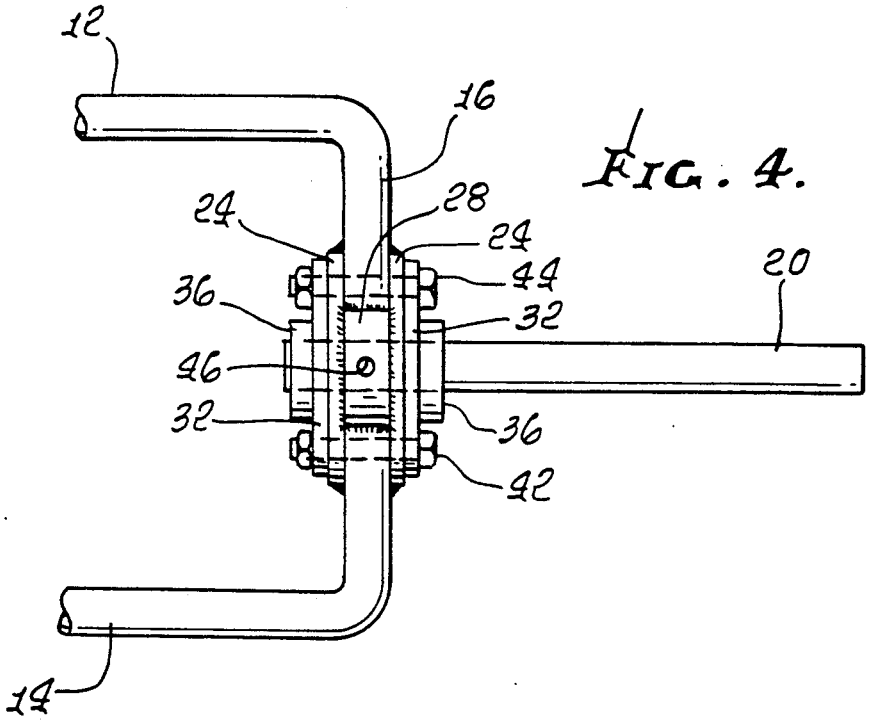
FIG. 4 is an enlarged view of the right hand portion of the device of FIG. 3 including the hand.

For other uses, relative rotation is imperative. In one preferred use, the device is carried along by two ice skaters, each holding the frame up by an end handle. As the device is carried along, the performer manually grips the bars of the frame and rotates or flips about the frame as indicated in FIG. 2. The device can also be locked by the collars 36 and 38 so that the performer can sit, lay or stand on the frame. Thus, the device lends itself to the performance of a wide array of acrobatic acts.

The device of the present invention is very versatile by virtue of the locking pins at cylindrical collars 28 and 30 which can be inserted or removed, at will, to alter the mode of use of the device of the present invention.

Having fully described the invention, it is intended that it be limited only by the lawful scope of the appended claims.

I claim:

1. A portable hand hale exercising device designed to be carried by a plurality of persons, wherein at least a third, performing person engages in acrobatics while being supported on said device, said device consisting essentially of: a first pair of parallel bars and a second pair of parallel bars, said first pair of parallel bars having a length greater than said second pair of parallel bars, said first pair of parallel bars, said first pair of parallel bars being joined at their ends by said second pair of parallel bars to form a rectangular frame member and a pair of horizontally positioned outwardly extending end handles rotatably mounted midway of said second pair of parallel bars.

2. A device of claim 1 wherein said device has locking pins to prevent rotation of the frame with respect to the end handles.

3. The device of claim 1 wherein the first pair of parallel bars are spaced about twelve inches apart parallel bars at each of their ends, and said end handles are positioned mid-way between said parallel bars and extend from each of said second pair of parallel bars.

4. The device of claim 1 wherein the device has self centering bearings mounted on said second pair of parallel bars at each side of the frame in which the handles are received and adjustably held by Allen screws.

5. The device of claim 4 wherein a cylindrical collar is affixed around each side of the frame and plates are welded to the collar, said self centering bearings are held to such plates by bolts and the bearings further retained by said locking collars.

* * * * *